United States Patent [19]

Ohba

[11] Patent Number: 4,457,154

[45] Date of Patent: Jul. 3, 1984

[54] CONTROL METHOD FOR MULTI-STRAND ROLLING MILL

[75] Inventor: Koichi Ohba, Kobe, Japan

[73] Assignee: Mitsubishi Denki Kabushiki Kaisha, Tokyo, Japan

[21] Appl. No.: 480,090

[22] Filed: Apr. 4, 1983

Related U.S. Application Data

[62] Division of Ser. No. 246,316, Mar. 23, 1981, abandoned.

[51] Int. Cl.[3] ..... B21B 1/20; B21B 37/08

[52] U.S. Cl. ..... 72/234; 72/15; 72/221; 72/240; 72/248

[58] Field of Search ..... 72/234, 221, 14, 15, 72/248, 365, 366, 240

[56] References Cited

U.S. PATENT DOCUMENTS

| | | | |
|---|---|---|---|
| 1,935,048 | 11/1933 | Gassen | 72/234 |
| 2,933,956 | 4/1960 | Snow | 72/240 |
| 3,625,043 | 12/1971 | Neumann et al. | 72/365 X |

FOREIGN PATENT DOCUMENTS

| | | | |
|---|---|---|---|
| 55-86613 | 6/1980 | Japan | 72/14 |
| 56-114513 | 9/1981 | Japan | 72/240 |

OTHER PUBLICATIONS

K. A. Petraske, "Developments in Drive Systems and Gage Control for Reversing Cold Mills", *Iron and Steel Engineer,* 1961, pp. 151–157.

*Primary Examiner*—Francis S. Husar
*Assistant Examiner*—Steven B. Katz
*Attorney, Agent, or Firm*—Wenderoth, Lind & Ponack

[57] ABSTRACT

When two strand workpieces pass through a roll opening between two grooved working rolls on a roll stand so as to be rolled, the trailing end of one of them may leave the rolls and cause change in the roll separation. At that time mating bilateral screw-down devices are remotely controlled to adjust the roll opening at least at the position of the remaining workpiece. Alternatively in a multi-strand tandem rolling mill, the rolling speeds on roll stands upstream of a roll stand which one of the strand workpieces has left are changed by a speed ratio of $(1-b_2)/(1-b_1)$ where $b_1$ and $b_2$ respectively designate rates of backward slip when two strand workpieces are being rolled and in the absence of one of the strand workpieces from the last-mentioned roll stand. Alternatively the roll speeds on roll stands downstream of the roll stand which one of the strand workpieces has left may be changed by a speed ratio of $(1+f_2)/(1+f_1)$ where $f_1$ and $f_2$ respectively designate rates of forward slip corresponding to the rates of backward slip $b_1$ and $b_2$.

4 Claims, 5 Drawing Figures

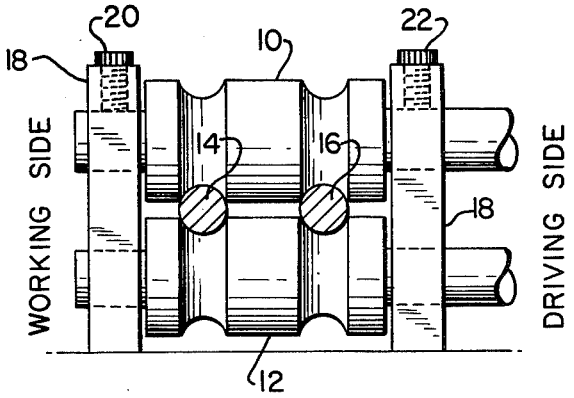
FIG. 1
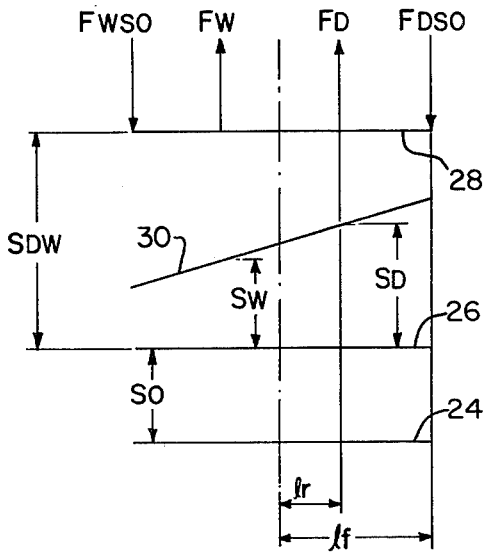
FIG. 2
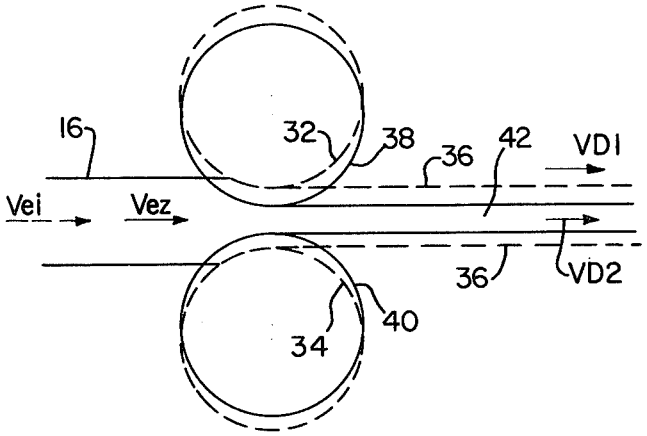
FIG. 3
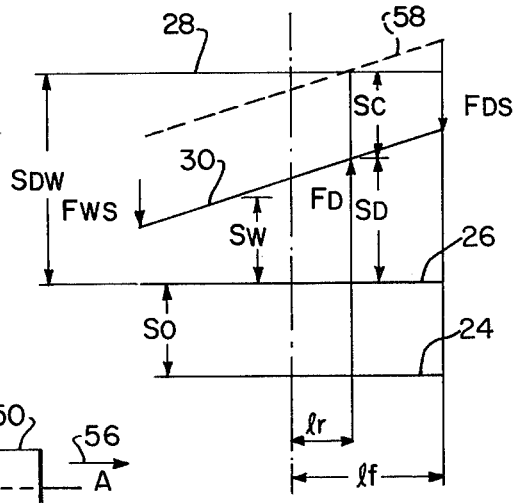
FIG. 5
FIG. 4
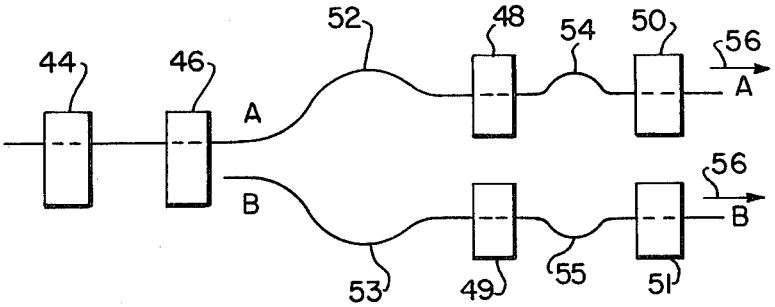

CONTROL METHOD FOR MULTI-STRAND ROLLING MILL

This application is a division of now abandoned application Ser. No. 246,316, filed Mar. 23, 1983.

BACKGROUND OF THE INVENTION

This invention relates to a control method for a multi-strand rolling mill, and more particularly to a method in which the control is responsive to at least one strand workpiece leaving or entering a roll stand, which roll stand is simultaneously rolling a plurality of strand workpieces, to remove the influence of the strand workpiece which has left or entered the stand on the remaining strand workpieces being rolled in the stand for a single roll stand and on the remaining strands being rolled in the roll stands for a multi-strand rolling mill.

Multi-strand rolling mills comprise a roll stand including a pair of upper and lower working rolls each having, for example, a pair of circumferentially extending grooves positioned in spaced relationship on the surface thereof and opposed to like grooves on the other working rolls. The grooves on the upper and lower working rolls form therebetween a roll opening the size of which is controllable by bilateral manual screw-down devices.

In operation, a pair of strand workpieces pass simultaneously through the roll opening between the working rolls so as to be simultaneously rolled into shapes determined by the shape of the opposed forming grooves. However, the trailing end of one of the strand workpieces may leave one of the spaces between the grooves in the upper and lower rolls before the other strand workpiece. This causes a change in roll opening. Also when a leading end of another strand workpiece enters the roll opening at the position of the empty opposite forming grooves, the roll opening is changed. Therefore the rolled strand may not be uniform in dimension due to this changing of the roll opening.

One example of multi-strand rolling mills comprises a plurality of roll stands disposed in tandem to roll simultaneously, for example, a pair of strand workpieces, and the plurality of roll stands is followed by a pair of branched arrays of roll stands disposed in tandem, one for each strand workpiece, so as to roll only one respective workpiece. Each of the roll stands for simultaneously rolling the pair of strand workpieces includes a pair of upper and lower working rolls as described above and each of the roll stands in the branched arrays includes a pair of upper and lower working rolls different from those described above only in that a single forming groove is provided in each working roll.

When the roll opening changes on one of the roll stands with the double grooved working rolls for the reason as described above, entry and delivery speeds of the strand workpieces in that roll stand change. As a result, the prior art multistrand rolling mill has been unable to keep a constant mass flow of the workpieces during the normal operation.

Although when at least one strand workpiece has left or entered an associated roll stand during the simultaneous rolling of a plurality of strand workpieces so that the entry and delivery speeds of the remaining strand workpieces change, conventional control methods for multi-strand rolling mills have not particularly compensated for the change in speed. Therefore each of the remaining strand workpieces being rolled on the roll stand has the loop disposed downstream thereof changed greatly with the result that all the roll stands downstream thereof are adversely affected. On the other hand, because that roll stand from which at least one strand workpiece has departed has a smaller mass flow therethrough than the roll stand upstream thereof, a compression force is generated on the remaining stand extending between those roll stands.

Accordingly it is an object of the present invention to provide a new control method for controlling a multi-strand rolling mill so that the roll opening is always maintained on any roll stand disposed in the rolling mill so as to roll simultaneously a plurality of strand workpieces regardless of whether or not only one of the strand workpieces is present in that roll stand.

It is another object of the present invention to provide a new control method controlling a multi-strand rolling mill comprising a plurality of roll stands disposed in tandem so that when at least one of a plurality of strand workpieces leaves or enters any one of the roll stands simultaneously rolling the strand workpieces, a constant mass flow of the strand workpieces is maintained throughout the rolling mills.

SUMMARY OF THE INVENTION

According to one aspect thereof, the present invention provides a control method for a multi-strand rolling mill for similtaneously rolling a plurality of strand workpieces, comprising the steps of tracking the trailing end and the leading end of each of a plurality of strand workpieces, and controlling the roll opening on a roll stand simultaneously with the departure of a trailing end from or entrance of a leading end of at least one strand workpiece into the roll stand.

According to another aspect thereof, the present invention provides a control method for a multi-strand rolling mill comprising a plurality of strand stands disposed in tandem to roll simultaneously a plurality of strand workpieces, comprising the steps of tracking the trailing end and the leading end of each of a plurality of strand workpieces, and each time at least one strand workpiece passes through each of the roll stands N, adjusting the first rolling speeds on the roll stands N−1,N−2 etc. upstream of the roll stand through which the end of at least one strand workpiece passes, second rolling speeds on the roll stand N through which the strand passes and third rolling speeds on the roll stands N+1,N+2 etc. downstream of the roll stand through which the end of the strand passes so as to keep the speed ratio of the three roll stands constant and the mass flow of the strand workpieces throughout the multistrand rolling mill constant.

In a preferred embodiment of the present invention, the control method makes the speed ratio equal to $$(1-b_2)/(1-b_1):1:(1+f_2)/(1+f_1)$$

whereby $b_1$ and $f_1$ designate the rate of backward slip and the rate of forward slip on the roll stand through which the end of the one strand workpiece passes respectively when all the strand workpieces are present in said roll stand and $b_2$ and $f_2$ designate the rate of backward slip and the rate of forward slip in said roll stand when the end of the one strand workpiece has passed through said roll stand.

BRIEF DESCRIPTION OF THE DRAWINGS

The present invention will become more readily apparent from the following detailed description taken in conjuction with the accompanying drawings in which:

FIG. 1 is a front elevational view of the essential portion of a roll stand for simultaneously rolling a pair of strand workpieces with the strand workpieces illustrated in cross section;

FIG. 2 is a diagram illustrating the roll opening between the upper and lower working rolls shown in FIG. 1 depening on the number of strand workpieces under rolling;

FIG. 3 is a schematic side elevation view of the working rolls shown in FIG. 1 illustrating one of the strand workpieces as shown in FIG. 1 being rolled;

FIG. 4 is a schematic plan view of a double-strand rolling mill; and

FIG. 5 is a diagram similar to FIG. 2 but illustrating the control of the roll opening between the working rolls of a roll stand according to the present invention.

DESCRIPTION OF THE PREFERRED EMBODIMENTS

Referring now to FIG. 1 of the drawings, there is illustrated the essential portion of a roll stand for rolling a pair of strand workpieces simultaneously. The arrangement illustrated comprises a pair of upper and lower working rolls 10 and 12 respectively superposed on each other to form a roll opening therebetween. Each of the upper and lower rolls 10 and 12 includes a plurality of forming grooves, in this case, two grooves extending circumferentially in spaced relationship around the entire surface thereof and opposed to corresponding grooves on the other roll. Each of the pairs of opposed grooves defines an opening having the cross section substantially corresponding to that of a strand workpiece to be rolled. In FIG. 1 a pair of strand workpieces 14 and 16 are shown in cross section as being rolled between the opposed forming grooves on the upper and lower rolls 10 and 12 respectively, with a small spacing being left between the cylindrical surfaces of the roll. The lower roll 12 has a pair of shafts protruding from the ends thereof and rotatably mounted on the opposite lateral walls of a housing 18. The upper roll 10 has a pair of similar shafts not only rotatably mounted in the walls but also movable toward and away from the lower roll 12 under the control of bilateral manual screw-down devices 20 and 22 disposed in the upper portions of the opposite wall of the housing 18 on the working and driving sides respectively, the driving side being that from which the power to drive the rolls is supplied.

The screw-down device may be an electrically operated type or an oil pressure type but is generally of the manually operated type in rolling mills for rolling a plurality of strand workpieces simultaneously.

The roll opening between the upper and lower working rolls 10 and 12 respectively is varied in accordance with the load as shown in FIG. 2. In the non-loaded condition, i.e. in the absence of strand workpieces therebetween, the upper and lower rolls 10 and 12 respectively are located at the positions as shown by the horizontal lines 26 and 24 in FIG. 2 so as to maintain therebetween a roll separation $S_o$ of a magnitude determined by the particular rolling schedule. In FIG. 2 the lower roll 12 is fixed in position as shown by lower horizontal line 24.

When the pair of strand workpieces 14 and 16 are simultaneously present between the two rolls 12 and 14 as shown in FIG. 1, the upper roll 12 is located at the position as shown by horizontal line 28 in FIG. 2. However when only the strand workpiece 16 on the driving side is disposed between the two rolls 10 and 12, the upper roll 10 is located at the position as shown by the slanted line 30 in FIG. 2.

Conventional rolling methods and the drawbacks thereof will now be described with reference to both conventional roll stands such as shown in FIG. 1 and the positions of the upper and lower working rolls as shown in FIG. 2. It is assumed that such a roll stand rolls only a pair of strand workpieces for purposes of illustration.

According to the conventional rolling method, the rolling speed of the rolls in each of the roll stands arranged in succession in an associated rolling mill is preliminarily set at a magnitude determined by the rolling pass schedule to be used and the pair of bilateral screw-down devices on each roll stand has been manually operated to set the roll opening between the mating upper and lower working rolls at a magnitude as determined by that schedule.

The strand workpieces 14 and 16 as shown in FIG. 1 are simultaneously rolled by the rolling mill as described above so that those workpieces are successively rolled on the successive roll stands. During the rolling, there will be gaps or spaces along each of the workpiece paths along which the strand workpieces travel between the trailing ends of leading strand workpieces and the leading ends of the next succeeding strand workpieces. As a result, the condition of the roll stand as shown in FIG. 1 may change from that in which two strand workpieces 14 and 16 are simultaneously being rolled to a condition in which only one or the other of the strand workpieces is being rolled.

When two workpieces are present in the forming grooves on the working and driving sides, it will be assumed that in FIG. 2 $F_W$ and $F_D$ designate the respective rolling forces for the workpiece 14 on the working side and for the workpiece 16 on the driving side. Under the assumed conditions screwing-down forces $F_{WSO}$ and $F_{DSO}$ are generated, as reactions to those rolling forces, at screw-down positions on the working and driving sides respectively and $$F_W+F_D=F_{WSO}+F_{DSO} \quad (1)$$

Also assuming that M designates a mill constant for the roll stand, those forces $F_W$ and $F_D$ tending to cause the roll opening $S_o$ between the upper and lower working rolls to increase by a magnitude $S_{DW}$ are expressed by $$S_{DW}=(F_W+F_D)/M \quad (2)$$

and the upper roll 10 occupies the position as shown by the horizontal line 28 in FIG. 2. In other words, when the roll stand as shown in FIG. 1 performs a rolling operation on a pair of strand workpieces passing therethrough, the roll opening of $(S_o+S_{DW})$ is formed between the upper and lower rolls 10 and 12 respectively. Therefore, the product has a dimension corresponding to that roll opening.

It will next be assumed that the strand workpiece 14 has been rolled by the roll stand as shown in FIG. 1 and has left the roll stand and only the strand workpiece 16 is still being rolled. Under this assumed condition the roll force $F_W$ disappears. As a result, the upper roll 10 occupies the position as shown by the slanted line 30 and the opening $S_{DW}$ decreases to a magnitude $S_D$ at the position of the strand workpiece 16. It is further assumed that $(S_D+S_o)$ designates the roll opening at the position of the strand workpiece 14, $l_r$ the distance between the central section of the working roll perpendicular to the longitudinal axis and the position of the respective workpieces 14 and 16 and $l_f$ designates the distance between that central section and each of the screw-down positions. Under the assumed conditions $$F_D = F_{WS} + F_{DS}$$

and $$F_{WS}(l_r+l_f) = F_{DS}(l_r-l_f).$$

Therefore $$S_D = \frac{F_D}{M} \cdot \frac{l_f^2 + l_r^2}{l_f^2} \quad (3)$$

and $$S_W = \frac{F_D}{M} \cdot \frac{l_f^2 - l_r^2}{l_f^2} \quad (4)$$

From the foregoing it is seen that in the arrangement of FIG. 1 the roll opening at the position of the strand workpiece 16 changes between the magnitudes $(S_o+S_{DW})$ and $(S_o+S_D)$ depending on whether or not the strand workpiece 14 is present in the roll stand. This has resulted in the disadvantage that the rolled product is not uniform in dimension.

FIG. 3 shows the manner in which the arrangement of FIG. 1 is rolling the strand workpiece 16. During the rolling of two workpieces 14 and 16 the roll opening at the position of the workpieces 16 is that between the positions of the upper and lower roll designated by upper and lower dotted circles 32 and 34 respectively. That roll opening corresponds to the roll opening $(S_o+S_{DW})$ shown in FIG. 2. The workpiece 16 enters at an entry speed $V_{E1}$ into that roll opening and is rolled into a strand workpiece 36. The rolled workpiece 36 leaves the roll opening at a delivery speed $V_{D1}$.

Next it is assumed that the workpiece 14 leaves the upper and lower rolls after having been rolled and only the workpiece 16 is being rolled. At that time the roll opening at the position of the workpiece 16 is that between the positions of the upper and lower rolls designated by the upper and lower solid circles 38 and 40 respectively. That roll opening corresponds to the roll separation $(S_o+S_D)$ shown in FIG. 2. The workpiece 16 enters the roll opening at an entry speed $V_{E2}$ and is rolled into a strand workpiece 42. The rolled work piece 42 leaves the roll opening at a delivery speed $V_{D2}$.

In FIG. 3, the upper and lower working rolls have a common speed of rotation which remains unchanged whether or not the workpiece 14 is present between the working rolls. However, the rolled workpiece 42 has the ratio of its delivery speed to the circumferential speed of the roll (which is called hereinafter the rate of forward slip) larger than that of the rolled workpiece 36 because the rolls are screwed down more on the workpiece 42 than on the workpiece 36. Therefore, at the outlet side of the rolls the workpiece 36 moves at a slower delivery speed than workpiece 42. That is, $V_{D1} < V_{E1}$ will be higher than $V_{E2}$ due to a change in the rate of backward slip which is the ratio of the entry speed of a strand workpiece to the circumferential speed of the working roll.

FIG. 4 shows a multi-strand rolling mill. The arrangement illustrated comprises a pair of roll stands 44 and 46 disposed in succession to roll a pair of strand workpieces A and B simultaneously and a pair of branch arrays one including two roll stands 48 and 50 and the other having two roll stands 49 and 51 disposed in succession to roll as associated one of the strand workpieces A or B. The workpiece A is being rolled on the roll stands 44, 46, 48 and 50 and it travels along loops 52 and 54 between the roll stands 46 and 48 and between the roll stands 48 and 50 respectively. The workpiece A leaves the roll stand 50 as shown at the arrow 56 in FIG. 4.

On the other hand, the trailing end of strand workpiece B is shown in FIG. 4 as having just left the roll stand 46 and forming similar loops 53 and 55 between the roll stands 46 and 49 and between the roll stands 49 and 51 respectively. Thereafter the workpiece B leaves the roll stand 51 as shown at the arrow 56 in FIG. 4.

It will readily be seen that the roll stand 46 shown in FIG. 4 corresponds to that described above in conjuction with FIG. 3 because the strand workpiece B is shown in FIG. 4 as having just left the roll stand 46.

In the arrangement of FIG. 4 the roll stands 44, 46, 48, 49, 50 and 51 have respective rolling speeds or speeds of the rolls such that each of the roll stands handles a mass flow of the workpiece A or B per unit time which is equal to that handled by the other roll stands. However, when the workpiece B leaves the roll stand 46 and therefore the delivery speed of the strand workpiece A increases to the magnitude $V_{D2}$ from $V_{D1}$ while at the same time the entry speed thereof decreases to the magnitude $V_{E2}$ from $V_{E1}$ as described above in conjuction with FIG. 3, the result is that the mass flow of the strand workpiece A changes and thus the mass flow does now remain constant throughout the arrangement of FIG. 4.

This remains true until a strand workpiece following the workpiece B enters the roll stand 46. However, conventional control methods for the multi-strand rolling mill have not included any special step of controlling such changes in entry and delivery speeds of the strand workpiece during rolling. Therefore the shape of the loop 52 of the strand workpiece A located downstream of that roll stand from which the one strand workpiece B has departed is changed greatly. This has adversely affected the rolling effected by the roll stands disposed downstream of the loop 52 the shape of which has changed. In addition, because the mass flow in roll stand 46 is smaller than in the roll stand 44 disposed upstream thereof, a compressive force on the strand workpiece is generated therebetween. This has resulted in a large defect in the rolled product.

According to one aspect thereof, the present invention contemplates maintaining a constant roll separation at the position of each of the strand workpieces being rolled in each roll stand disposed in a multi-strand rolling mill when simultaneously rolling a plurality of strand workpieces, regardless of whether or not one strand workpiece leaves or enters that roll stand while the other strand is being rolled.

To this end, each of the manual screw-down devices 20 or 22 as shown in FIG. 1 is replaced by a remotely actuatable, fast response screw-down device such as an electrically operated or an oil pressure operated screw-down device and there is provided tracking means for tracking the leading and the trailing end of each of the strand workpieces. Simultaneously with the sensing of a trailing or leading end of at least one of the strand workpieces leaving or entering a roll stand, the roll opening in that roll stand is controlled by the screw-down devices disposed on the roll stand to remain constant.

Referring back to FIG. 1, let it be assumed that the roll stand illustrated changes from the state in which the two workpieces 14 and 16 are simultaneously being rolled to the state in which the workpiece 14 has left the roll stand. Under the assumed conditions, the position of the upper roll 10 as shown by line 28 in FIG. 2 of the upper roll 10 changes to the position as shown by line 30 in FIG. 2 so as to change the roll opening at the rolling position on the driving side from the magnitude $(S_{DW}+S_o)$ to $(S_D+S_O)$ as described above in conjuction with FIG. 2. Therefore the leading and trailing ends of the strand workpiece 14 being rolled on the working side are always tracked and simultaneously with the trailing end of that strand workpiece leaving the roll stand, the two screw-down devices on the working and driving sides are simultaneously driven to move the upper roll 10 so that it occupies the position as shown by the slanted dotted line 58 in FIG. 5 which is parallel to the line 30 in FIG. 2 excepting that in FIG. 5 the dotted line 58 is spaced from line 30 by a distance equal to $S_c$. This produces a roll opening $(S_{DW}+S_o)$ at the rolling position on the driving side of the roll stand.

From the foregoing it is seen that the two screw-down devices control the movement of the upper roll to increase the roll opening at the rolling position on the driving side of the stand by a magnitude $S_c$ expressed by $$S_{DW} - S_D = \frac{1}{M}\left(F_W - F_D\frac{l_r^2}{l_f^2}\right).$$

As $F_D = F_W$ generally holds, $$S_C = \frac{F_D}{M}\left(\frac{l_f^2 - l_r^2}{l_f}\right) = S_W$$

This means that the roll opening increases by a magnitude corresponding to $S_W$ defined by the expression (4).

From the foregoing it will readily be understood that when the leading end of the next strand workpiece enters the roll stand on the working side, the screw-down devices must be operated to move the upper roll so that the roll opening at the rolling position on the driving side of the stand is simultaneously decreased by the magnitude $S_W$.

In this way the size of the roll opening at the rolling position of the strand workpiece on the driving side of the rolling stand is maintained constant regardless of the presence or absence of a strand workpiece on the working side of the rolling stand.

While the present invention has been described in conjuction with the presence or absence of the strand workpiece on the working side of the rolling stand, it is to be understood that the same is equally applicable to whether or not the strand workpiece is present or absent from the rolls on the driving side of the rolling stand. In the latter case, the leading and trailing ends of the strand workpiece on the driving side are tracked and the roll opening at the rolling position of the strand workpiece on the working side is increased or decreased by the magnitude $S_D$ defined by the expression (3) simultaneously with the leaving of the trailing end or entry of the leading end of the strand workpieces on the driving side of the roll stand.

It is also to be understood that by controlling the screw-down devices on the working and driving sides to move the shafts on the working and driving sides by different screw-down magnitudes, the upper roll may be made to occupy the position as shown at line 28 if FIG. 5 with a satisfactory result. In summary it is essential in the present invention to maintain the roll opening at the rolling position of the strand workpiece being continuously rolled at a constant magnitude $(S_{DW}+S_o)$ whether there is one strand workpiece missing from the roll stand or not.

In the foregoing, the roll opening has been described as being increased or decreased simultaneously with the departure of the strand workpiece from the roll stand or the entry of the strand workpiece into the roll stand, but this entering or departure takes place over some time interval. Therefore the increase or decrease in the roll opening is preferably made during the time interval corresponding to the entering or departure of the strand workpiece.

While the present invention has been described in conjuction with the simultaneous rolling of two strand workpieces it is to be understood that the same is equally applicable to the simultaneous rolling of more than two strand workpieces. In the latter case the roll opening on the roll stand is controlled in a manner similar to that described above so that, when at least one strand workpiece leaves or enters the roll stand, the influence of the resulting change of that roll opening on the remaining strand workpieces is minimized.

Also the present invention has been described by using expressions formulated by way of example, with the positions of the strand workpieces during rolling bilaterally symmetrical about a central control section of an associated working roll perpendicular to the longitudinal axis thereof, but it is to be understood that the present invention is equally applicable to rolling with the strand workpieces at positions bilaterally asymmetric about that central section. In the latter case the fundamental method of control is identical to that described above in conjuction with the symmetric positions of the strand workpieces during rolling excepting that the magnitudes of the change of position of the roll are different from those described above.

According to another aspect thereof, the present invention contemplates maintaining a constant mass flow throughout a multi-strand rolling mill comprising a plurality of roll stands disposed in succession to roll simultaneously a plurality of strand workpieces even when at least one of the strand workpieces leaves or enters one of the roll stands.

In FIG. 3 it is assumed that each of the upper and lower rolls is rotated at a constant circumferential speed or a constant rolling speed $V_R$ and each of the plurality of strand workpieces has an entry speed $V_{E1}$ and a delivery speed $V_{D1}$ with a large roll opening or when all of the strand workpieces are present between the rolls as well as an entry speed $V_{E2}$ and a delivery speed $V_{D2}$ with a small roll opening or in the absence of at least one strand workpieces from between the rolls as described above. It is further assumed that, when the roll opening is large, $r_1$, $f_1$ and $b_1$ designate the reduction rate, the rate of forward slip and the rate of backward slip, respectively, while, when the roll opening is small, $r_2$, $f_2$ and $b_2$ designate the reduction rate, the rate of forward slip and the rate of backward slip, respectively. Under the assumed conditions, the following relationships exist:

$$V_{E1}=V_R(1-b_1) \quad (5)$$

$$V_{E2}=V_R(1-b_2) \quad (6)$$

$$V_{D1}=V_R(1+f_1) \quad (7)$$

$$V_{D2}=V_R(1+f_2) \quad (8)$$

Therefore $$V_{D1}=V_{E1}/(1-r_1) \quad (9)$$

and $$V_{D2}=V_{E2}/(1-r_2) \quad (10)$$

From the above expressions it is seen that when the strand workpiece B has left the roll stand 46 as shown in FIG. 4, the entry speed of the strand workpiece A changes from its magnitude $V_{E1}$ to $V_{E2}$ as long as the rolling speed $V_R$ of the roll stand 46 remains unchanged. In order to prevent this change in entry speed from affecting the strand workpiece A, each of the roll stands disposed upstream of the roll stand 46 must have the rolling speed thereof changed by a ratio of $V_{E2}$ to $V_{E1}$ expressed by $$\frac{V_{E2}}{V_{E1}}=\frac{1-b_2}{1-b_1} \quad (11)$$

Similarly the rolling speed of each of the roll stands disposed downstream of the roll stand 46 for the strand workpiece A must have the roll speed thereof changed by a ratio of $V_{D2}$ to $V_{D1}$ expressed by $$\frac{V_{D2}}{V_{D1}}=\frac{1+f_2}{1+f_1} \quad (12)$$

While the measures as described above are necessary because the speed $V_R$ of the roll stand 46 remains unchanged, other measures may be adopted. More specifically, one of those measures is to change the speeds on all the roll stands disposed upstream of the roll stand 46 and the speed of roll stand 46 as well, and another measure is to change the speeds on all the roll stands disposed downstream of the roll stand 46 and the speed of the roll stand 46 as well.

Actually the speeds on the downstream roll stands are changed by a factor as defined by the expression (12). Thus the measure of changing the rolling speeds of each of the upstream roll stands while keeping the speeds of all the downstream roll stands constant can be achieved as follows: since the speed change of the downstream roll stand is expressed by the expression (12), it is required only to multiply the speeds on all the upstream roll stands including the roll stand 46 by the reciprocal of the factor defined by the expression (12). Thus, it is sufficient to multiply the speed of the roll stand 46 by a factor $(1+f_1)/(1+f_2)$ while at the same time multiplying the speeds of the roll stands disposed upstream of the roll stand 46 by a factor expressed by $$\frac{1-b_2}{1-b_1}\cdot\frac{1+f_1}{1+f_2}=\frac{1-r_2}{1-r_1}.$$

Similarly changing the delivery speeds of the strand workpiece on the downstream roll stands can be achieved by the multiplication of the speed of the roll stand 46 by a factor of $(1-b_1)/(1-b_2)$ and of the speeds of the roll stands disposed downstream thereof by a factor expressed by $$\frac{1+b_2}{1+b_1}\cdot\frac{1-b_1}{1-b_2}=\frac{1-r_1}{1-r_2}.$$

In the foregoing it will be understood that since the rates of forward slip $f_1$ and $f_2$ approximate unity (1), it is possible to change the roll speeds on all the roll stands upstream or downstream of the roll stand 46 by multiplying by the same factor respectively with a satisfactory result.

From the foregoing it is seen that, in order to prevent the effect of one strand workpiece leaving or entering one of the roll stands and the change of the roll separation in that roll stand from affecting the other strand workpieces adversely, the present invention provides a control method comprising the steps of tracking the trailing and leading ends of each of the strand workpieces, sensing when the trailing or leading end of any strand workpiece leaves or enters one of the roll stands, and changing the speed ratios on the roll stands disposed upstream or downstream of that roll stand or on all the roll stands simultaneously with this sensing of the entering or leaving of the workpiece. It is to be understood that it is essential to change the rolling, entry, delivery speeds on the roll stands upstream of the roll stand from which the strand workpiece has left or entered and those downstream thereof according to the following speed ratio $$(1-b_2)/(1-b_1):1:(1+f_2)/(1+f_1).$$

By changing the speeds on all the roll stands as described above, the mass flow of the stand workpieces is maintained constant throughout the multi-strand tandem rolling apparatus.

While the present invention has been illustrated and described in conjuction with a two-strand tandem rolling mill as shown in FIGS. 3 and 4, it is to be understood that numerous changes and modification may be resorted to without departing from the spirit and scope of the present invention. For example, it is to be understood that the present invention is equally applicable to any multi-strand rolling mill including a plurality of roll stands disposed in tandem to roll more than two strand workpieces simultaneously. Also the present invention has been described in conjuction with ratios with which the rolling speed are changed on the respective roll stands, but it is noted that strand workpieces do not leave or enter the roll stand instanteously and that each leaves or enters the roll stand within a constant period of time as determined by the speeds thereof, the diameter of the working rolls and screw-down rate on that roll stand. As a result, it has been found that a more satisfactory result is achieved by making the time interval over which the speeds are changed equal to the constant period of time as described above.

I claim:

1. A method for controlling the rolling stands of a multi-strand rolling mill having a plurality of roll stands disposed in succession for simultaneously rolling a plurality of strand workpieces, comprising the steps of tracking the trailing end and the leading end of each of the strand workpieces, and each time the trailing end of at least one strand workpiece leaves a roll stand, setting the rolling speeds of the roll stands upstream of the roll stand which the end of said at least one strand workpiece has left to a first rolling speed and the rolling speed of the roll stand which the end of the strand workpiece has left to a second roll speed, and setting the rolling speeds of the roll stands downstream of the roll stand which the strand workpiece has left to a third speed, the speeds being in a ratio for keeping the mass flow of the strand workpieces throughout the multi-strand rolling mill substantially constant.

2. A control method as claimed in claim 1 wherein the first, second and third rolling speeds are in a speed ratio $$(1-b_2)/(1-b_1):1:(1+f_2)/(1+f_1)$$

wherein $b_1$ and $f_1$ respectively designate the rate of backward slip and the rate of forward slip on the roll stand through which the end of the one strand workpiece passes when all the strand workpieces are present in the last-mentioned roll stand, and $b_2$ and $f_2$ respectively designate the rate of backward slip and the rate of forward slip on the last-mentioned roll stand when the end of at least one strand workpiece has passed through the last-mentioned roll stand.

3. A control method as claimed in claim 1 wherein the first and second rolling speeds are adjusted to be in a ratio $$(1-r_2)/(1-r_1):1$$

and the third rolling speed is kept unchanged, and wherein $r_1$ designates the screw-down rate for the roll stand through which the end of at least one strand workpiece has passed when all the strand workpieces are present therein and $r_2$ designates the screw-down rate for the last-mentioned roll stand when the end of at least one strand workpiece has left the last-mentioned roll stand.

4. A control method as claimed in claim 1 wherein the second and third rolling speeds are in a ratio $$(1-r_1)/1-r_2):1$$

and the first rolling speed is kept unchanged, and wherein $r_1$ designates the screw-down rate for the roll stand through which the end of at least one strand workpiece has passed when all the strand workpieces are present therein and $r_2$ designates the screw-down rate for the last-mentioned roll stand when the end of at least one strand workpieces has left the last-mentioned roll stand.

* * * * *